United States Patent [19]

Moreland

[11] Patent Number: 4,818,151

[45] **Date of Patent: * Apr. 4, 1989**

[54] SECONDARY CONTAINMENT SYSTEMS ESPECIALLY WELL SUITED FOR HYDROCARBON STORAGE AND DELIVERY SYSTEMS

[75] Inventor: Jack Moreland, Dolton, Ill.

[73] Assignee: MPC Containment Systems, Chicago, Ill.

[ * ] Notice: The portion of the term of this patent subsequent to Jul. 28, 2004 has been disclaimed.

[21] Appl. No.: 36,290

[22] Filed: Apr. 9, 1987

Related U.S. Application Data

[63] Continuation-in-part of Ser. No. 709,597, Mar. 8, 1985, Pat. No. 4,682,911, which is a continuation-in-part of Ser. No. 586,782, Mar. 6, 1984, abandoned, which is a continuation-in-part of Ser. No. 930,788, Nov. 14, 1986, Pat. No. 4,778,310.

[51] Int. Cl.[4] ..... B65G 5/00

[52] U.S. Cl. ..... 405/303; 137/236.1; 405/53; 405/270

[58] Field of Search ..... 405/53, 54, 55, 270, 405/303; 137/236.1, 312, 363, 371; 220/18

[56] References Cited

U.S. PATENT DOCUMENTS

| | | | |
|---|---|---|---|
| 2,507,597 | 5/1950 | Holdridge | 405/53 X |
| 3,407,606 | 10/1968 | Khan et al. | 405/54 |
| 3,940,940 | 3/1976 | Barrett | 405/270 |
| 4,366,846 | 1/1983 | Curati | 405/53 X |
| 4,406,403 | 9/1983 | Luebke | 405/270 X |
| 4,425,933 | 1/1984 | Fetsch | 137/236.1 X |
| 4,542,626 | 9/1985 | Colin | 405/53 X |
| 4,579,155 | 4/1986 | Zola | 137/363 X |
| 4,682,911 | 7/1987 | Moreland | 405/270 X |

*Primary Examiner*—David H. Corbin

*Attorney, Agent, or Firm*—Laff, Whitesel, Conte & Saret

[57] ABSTRACT

A fuel delivery system for a filling station provides a membrane which is formed as a continuous basin associated with at least one bulk storage tank and at least one remote delivery pump for dispensing the fuel upon demand with a plurality of pipes interconnecting the tank and the pump. The membrane at least partially surrounds the tank, completely surrounds the pipes, and extends under the pump for collecting any fuel spills or leakage. The earth or ballast supporting the membrane is graded to drain all collected fluids into a collection area, from which it may be pumped away. The membrane is under single walled fuel tanks and over double walled tanks. A frame supports the membrane above the tank while ballast is being packed around it.

13 Claims, 12 Drawing Sheets

COMPARATIVE PROPERTIES CHART

| PROPERTY | HYPALON | NEOPRENE | NORDEL | ELASTICIZED POLYOLEFIN |
|---|---|---|---|---|
| ADHESION TO FABRICS | GOOD | EXCELLENT | GOOD | N/A |
| TEAR RESISTANCE | EXCELLENT | EXCELLENT | EXCELLENT | GOOD |
| ABRASION RESISTANCE | EXCELLENT | EXCELLENT | EXCELLENT | GOOD |
| PERMEABILITY TO GASES | LOW | LOW | FAIR | FAIR |
| ACID RESISTANCE | | | | |
| DILUTE | EXCELLENT | EXCELLENT | EXCELLENT | EXCELLENT |
| CONCENTRATED | VERY GOOD | GOOD | POOR | VERY GOOD |
| SOLVENT RESISTANCE | | | | |
| ALIPHATIC HYDROCARBONS | GOOD | GOOD | POOR | FAIR |
| AROMATIC HYDROCARBONS | POOR | FAIR | POOR | FAIR |
| OXYGENATED (KEOTONES, ETC.) | POOR | POOR | GOOD | GOOD |
| RESISTANCE TO | | | | |
| SWELLING IN LUBRICATING OIL | GOOD | GOOD | POOR | POOR |
| OIL AND GASOLINE | FAIR | GOOD | POOR | FAIR |
| ANIMAL & VEGETABLE OIL | GOOD | GOOD | GOOD | GOOD |
| WATER ABSORPTION | GOOD | GOOD | GOOD | EXCELLENT |
| OXIDATION | EXCELLENT | EXCELLENT | EXCELLENT | EXCELLENT |
| OZONE | OUTSTANDING | EXCELLENT | OUTSTANDING | EXCELLENT |
| SUNLIGHT AGING | OUTSTANDING | VERY GOOD | OUTSTANDING | EXCELLENT |
| HEAT AGING | EXCELLENT | EXCELLENT | EXCELLENT | GOOD |
| HEAT | GOOD | GOOD | EXCELLENT | GOOD |
| COLD | GOOD | GOOD | EXCELLENT | GOOD |

FIG. 2 (A)

COMPARATIVE CHEMICAL RESISTANCE CHART

| FLUID | HYPALON | NEOPRENE | NORDEL | ELASTICIZED POLYOLEFIN |
|---|---|---|---|---|
| CREOSOTE OIL | C | C | C | T |
| CYCLOHEXANE | C | C | C | C |
| DETERGENT SOLUTION | ------ | ------ | ------ | A |
| DIABASIC ACIDE (C7-C12) | ------ | ------ | ------ | T |
| DIOCTYL PHTHALATE | C | C | C | A |
| ETHYL ACETATE | C | C | A | T |
| ETHYL ALCOHOL | A(158°F) | A(158°F) | A | A |
| ETHYLENE GLYCOL | B(158°F) | A(158°F) | A | A |
| FERRIC CHLORIDE | T | A | A | T |
| FLUOBORIC ACID | A | ------ | ------ | ------ |
| FLUOSILIC ACID | A(158°F) | A(158°F) | T | T |
| FORMIC ACID | A | A | A | A |
| FUEL OIL | B | ------ | ------ | ------ |
| FURFUROL | A | B | B | T |
| GASOLINE | B | B | C | C |
| GLUCOSE | A(158°F) | ------ | ------ | ------ |
| GLUE | A(158°F) | A(158°F) | A | A |
| GLYCERINE | A(158°F) | A(158°F) | A | T |
| HYDRAULIC OILS | B | ------ | ------ | ------ |
| HYDROCHLORIC ACID 37% | B(158°F) | A | B | B |
| HYDROCHLORIC ACID (CONC.) | ------ | ------ | ------ | ------ |
| HYDROCYANIC ACID | B | A | A | T |
| HYDROFLUORIC ACID 48% | B | A | B | T |
| HYDROFLUORIC ACID 75% | ----- | B | C | C |
| HYDROGEN SULFIDE | B | A | A | T |
| ISOPROPYL ALCOHOL | ------ | A | T | T |
| KEROSENE | X | B | C | C |
| LACQUER SOLVENTS | C | C | C | T |
| LACTIC ACID | A | A | A | T |
| LINSEED OIL | A | A | B | T |
| LUBRICATING OILS | B | B(158°F) | C | C |

FIG. 2(B)

COMPARATIVE CHEMICAL RESISTANCE CHART

| FLUID | HYPALON | NEOPRENE | NORDEL | ELASTICIZED POLYOLEFIN |
|---|---|---|---|---|
| TANNIC ACID 10% | A | A | A | ------ |
| TARTARIC ACID | B | A(158°F) | B | ------ |
| TOLUENE | C | C | C | C |
| TRIBUTYL PHOSPHATE | C | C | C | A |
| TRICHLOROETHYLENE | C | C | C | C |
| TRIETHANOLAMINE | A(158°F) | A(158°F) | A | ------ |
| TUNG OIL | A | A | C | ------ |
| TURPENTINE | C | C | C | C |
| VM+P NAPHTHA | ------ | ------ | ------ | C |
| WATER | A | A(212°F) | A(212°F) | A |
| XYLENE | C | C | C | C |

FIG. 2(C)

SECONDARY CONTAINMENT SYSTEMS ESPECIALLY WELL SUITED FOR HYDROCARBON STORAGE AND DELIVERY SYSTEMS

This is a continuation-in-part of Serial No. 6/709,597, filed on Mar. 8, 1985, now U.S. Pat. No. 4,682,911, which was a continuation-in-part of Ser. No. 6/586,782, filed Mar. 6, 1984, abandoned, and of Ser. No. 6/930,788, filed on Nov. 14, 1986, now U.S. Pat. No. 4,778,810.

This invention relates to secondary containment systems and especially—although not exclusively—to means for and methods of providing secondary containment systems for hydrocarbon storage and delivery systems.

A secondary containment system is a system which collects and contains an fluids leaking out of another and primary containment system. For example, a primary containment system may store and deliver gasoline at a corner filling station. A secondary containment system would collect and contain that same gasoline if a primary tank or delivery pipe should rupture or otherwise spill the gasoline. A secondary containment system would also catch gasoline which spills when a fill tube runs over while a fuel storage tank is being filled, for example. While the invention is described hereinafter in connection with a gasoline filling station storage and delivery system, it should be understood that the invention may also be used to protect any other suitable primary system.

Those who store gasoline or other liquids often do so in underground tanks buried in pits filled with sand, pebbles, and the like, called "ballast". However, such a tank may leak or liquid may be spilled on the surface of the earth in the area around the tank and seep down into the ballast. One way to prevent environmental damage from happening is to line the pit with a membrane before the ballast is installed. This way any leakage or spillage is collected in the bottom of a basin formed by the membrane. It is fairly easy to install the membrane when the earthen walls of the pit are present to support it while it is being installed.

Today, there is great public concern because materials and chemicals have penetrated into the underground water supply, contaminating the public drinking water and making some of the food supply unusable, among other things. Also, the entire environment is being degraded to a serious level which tends to cast doubt on future availability of safe water. Therefore, many governmental agencies have enacted and continue to enact laws which require a secondary containment system designed to capture and contain the spilled gasoline or other liquid material, thus preventing it from leaking into the surrounding earth. The captured gasoline or other liquid material may then be pumped out of the secondary stored gasoline.

The tanks may have either a single wall or double walls. The advantage of single wall tank construction is that it costs less. The advantage of the double wall tank construction is that if the inner tank wall leaks, the outer tank wall contains any resultant spill. If a single wall tank ruptures and spills any fluid contained therein, the inventive secondary containment system must be buried under such a tank in order to catch its spill. If the inner wall of the double wall tank ruptures, the outer wall catches the spill; thus, there is no need for an underlying containment system. On the other hand, the pipes which exit from the top of either type of tank may leak; therefore, for the double wall tank, there is still a need for the secondary containment system above the tank in order to catch that spill.

Since it costs less to place and service the secondary containment system when it is above the tanks there is also a need for an overlying system which is higher than the double wall tanks, and lower than the pipes. In some special cases, there may also be a need for a mixed secondary containment system, some elements of the system being above and some being below the tanks.

To provide for collection of spillage with double walled tanks, the practice has been to dig a pit, install the tanks, partially fill the pit with ballast to a level which covers the tanks, install the overliner membrane, and then finish filling the pit with ballast up to the surface level of the earth. The difficulty with this approach is that the ballast which is added to the pit when the overliner is installed tends to shift, slide, and otherwise provide an unreliable support for the overliner membrane. As the ballast slides or avalanches, the overliner may become dislodged or may be damaged to a point of failure.

The storage tanks are usually made of fiberglass, or the like, and that material must be fully and accurately supported by the surrounding earth to prevent a rupture of the tank wall under the unsupported weight of the stored gasoline.

Governmental agencies have also enacted occupational safety laws, designed to protect workmen by forbidding them to enter and work in a hazardous environment, unless safety devices are first installed to protect them. Insofar as the inventive secondary containment systems are concerned, these safety laws mean that the earthen walls of the collection pits or holes which are dug to bury the gasoline storage tanks must be shored to prevent cave in, before the workmen may enter those holes to install the ballast material. However, the shoring of these earthen walls is very expensive.

For these and other reasons, it is very difficult and expensive to meet all of the many different environmental and safety standards, at an acceptable cost. The problem is made worse since there are also very many state and local governments writing their own laws. Therefore, a secondary containment system must meet the most exacting of all the many laws.

Accordingly, an object of the invention is to provide new and improved secondary containment systems especially for filling stations, and the like. Here, an object is to provide a system which draws all fluids spilled within the filling station area into one or more central collecting points or sumps, which may be fully monitored. In this connection, an object is to provide means for and methods of removing the collected filling station fluids, or other material, for a proper disposal.

Another object of this invention is to provide new and improved means for and methods of installing overliner membranes in pits in which liquid storage tanks are buried. Another object is to provide means for collecting and centralizing leakage and spilled fluids in order to facilitate a clean up thereof. In this connection, an object is to return remote leakage through a trench into a basin formed by an overliner membrane.

Still another object of the invention is to provide secondary containment systems which may be placed either beneath or above buried tanks or may be placed at a mixture of locations both beneath and above a fluid storage tank.

In keeping with an aspect of the invention, these and other objects are provided by a membrane or sheet of material which is large enough to completely line a collection and containment system for a filling station or similar fuel distribution system. Fuel is stored in a tank buried in a pit or hole along with radiating trenches which drain into the collection pit. The trenches lead to the fuel distribution areas where pumps are located. The membrane may be positioned in a depression under the pumps, below single walled tanks, above double walled tanks, or in a combination both below and above the tanks, and in the trenches interconnecting the areas of the pumps and tanks. Either way, one or more low points or sumps are formed so that spilled fluids will drain there so that they may be collected, monitored, and pumped out of the containment system.

When the membrane is an overliner above the tank, it is hung from a frame, which may be made of conventional water pipe, for example, put together with conventional pipe fittings. The frame is set upon properly graded ballast which drains any collected liquids toward a collection point or sump. The membrane is spread over the graded ballast and hung from the pipe frame. Then, the remaining ballast is installed on both sides of the membrane so that it becomes a basin with a floor and with vertical sides which are always fully supported. A result is that the membrane basin is in the form of an open topped box in order to collect and retain any leakage or fluid which may be spilled on the surface. Various fittings enable structures, such as service wiring, to enter the basin and to collect fluids in remote locations, which drain into the basin.

Trenches may radiate from the collection containment pit or hole to various fluid dispensing locations (e.g. gasoline lines leading to pumps), with a bottom grading of the trenches to drain into the containment pit or hole. These trenches are also lined with a membrane to collect and direct any spilled fluids into the containment pit or hole.

Plastic zippers are used to close and to join the trench liners to each other and to the containment pit or hole liner. The zippers close the top of the liners, where necessary, to seal against a seepage of surface water. A cement or solvent may be placed in confronting surface areas of the zipper closing to preserve the integrity of its seal over the long years that an installation may be expected to remain in the ground.

The inventive secondary containment system is shown in the attached drawings, in which:

FIGS. 2A–2C are a table of materials which might be used to contain a great variety of different liquids;

Figure 1:
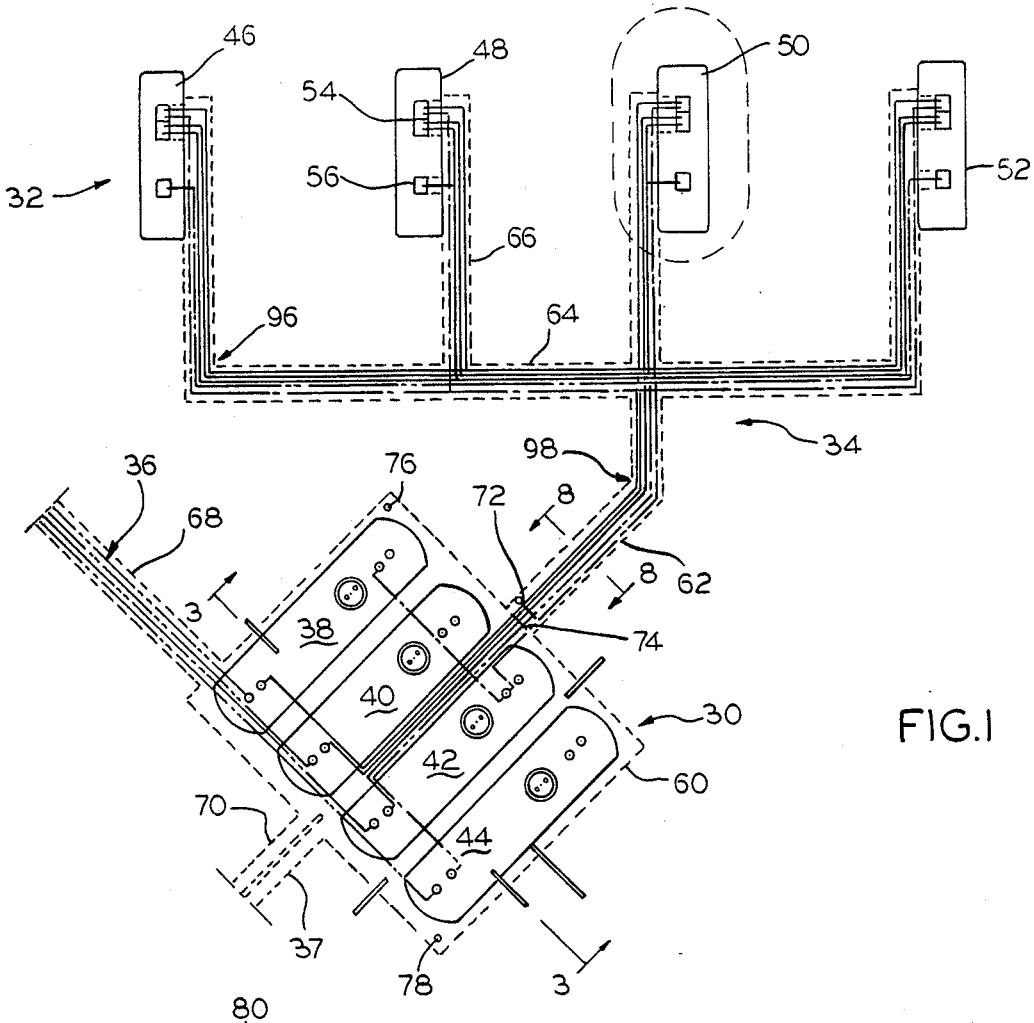
FIG. 1 is a schematic layout of an exemplary gasoline storage and delivery system which might use a single wall tank, such as one which might be found in a conventional filling station.
Figure 14:
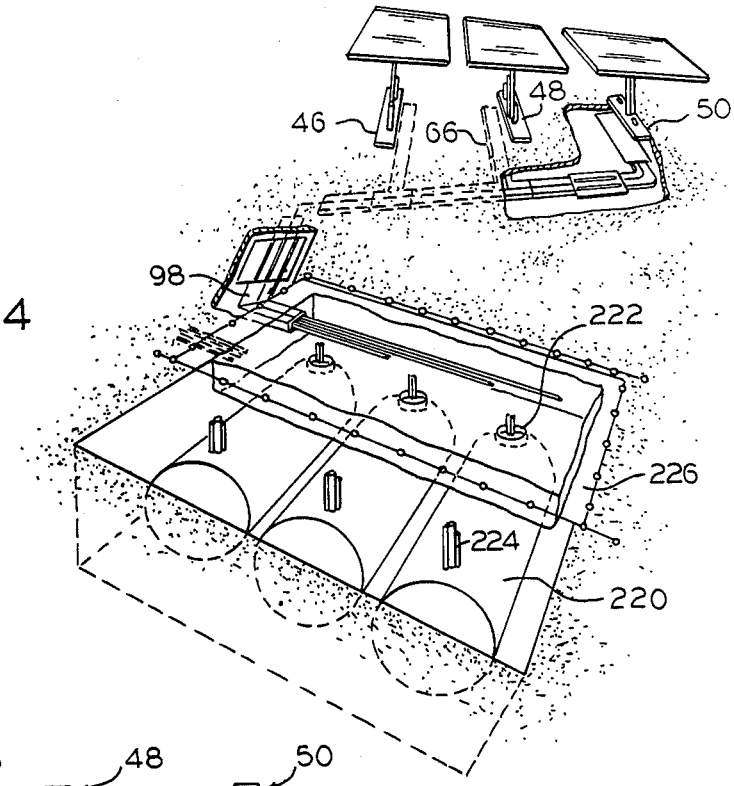
Figure 15:
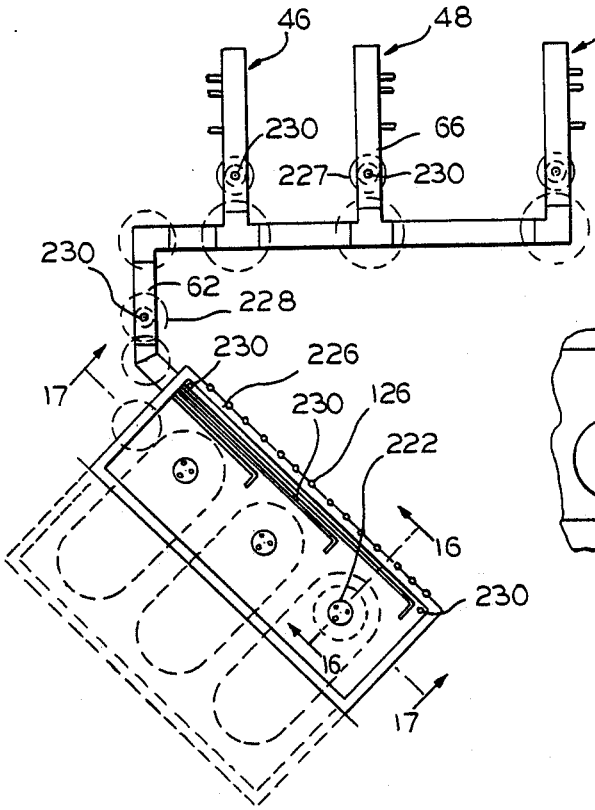
Figure 16:
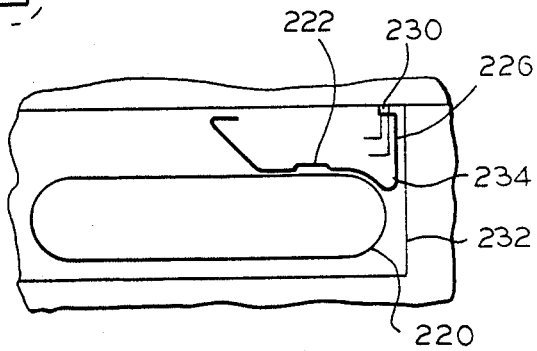
Figure 17:
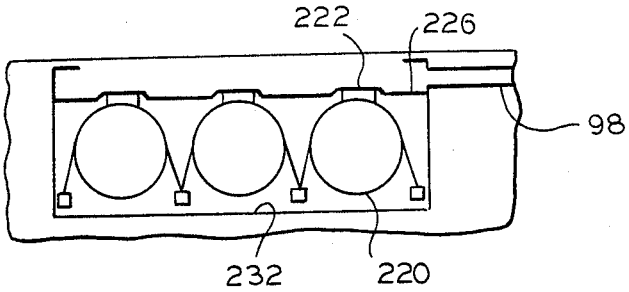
Figure 19:
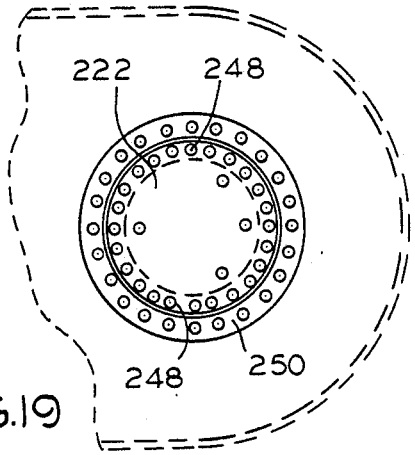
Figure 18:
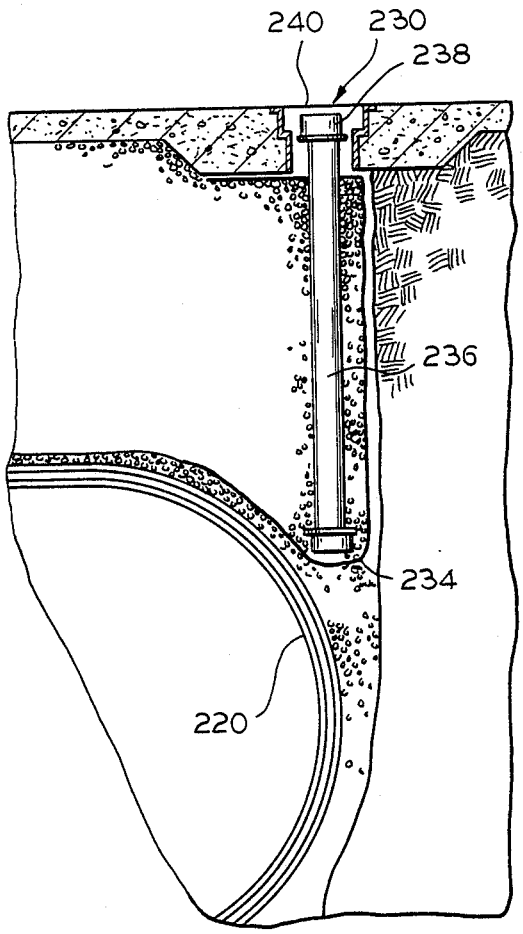
Figure 20:
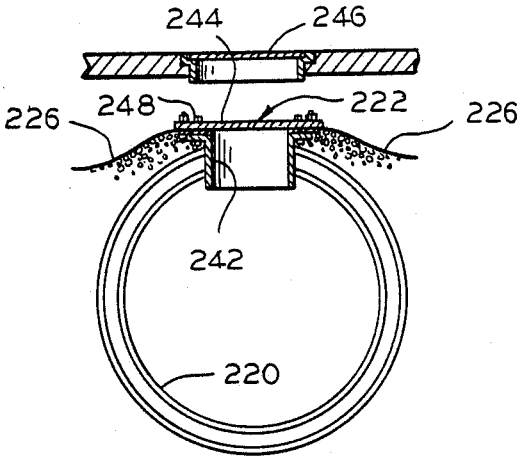
Figure 21:
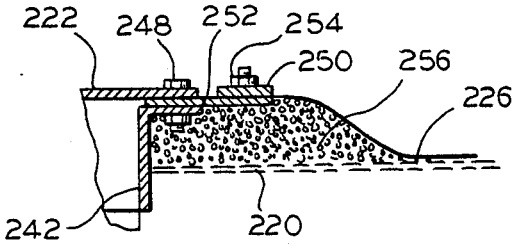
Figure 22:
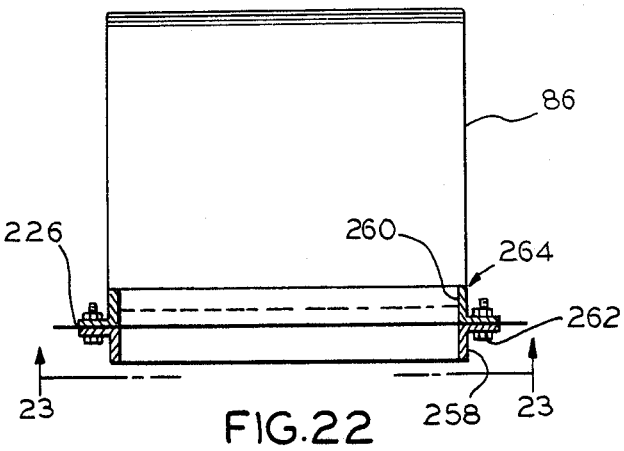
Figure 23:
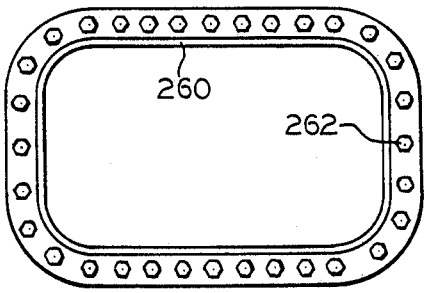
Figure 25:
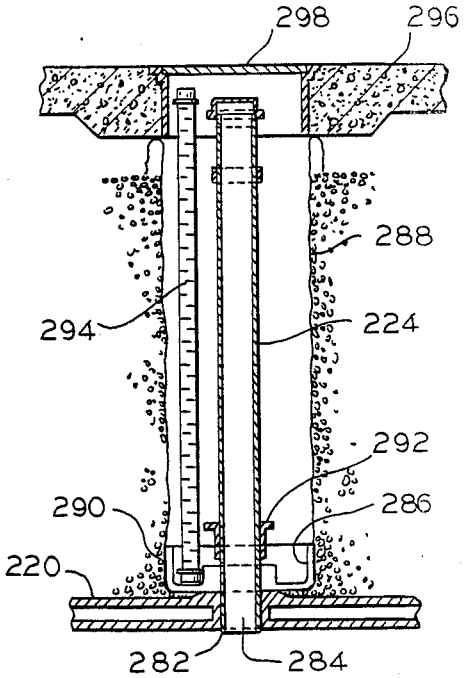
Figure 24:
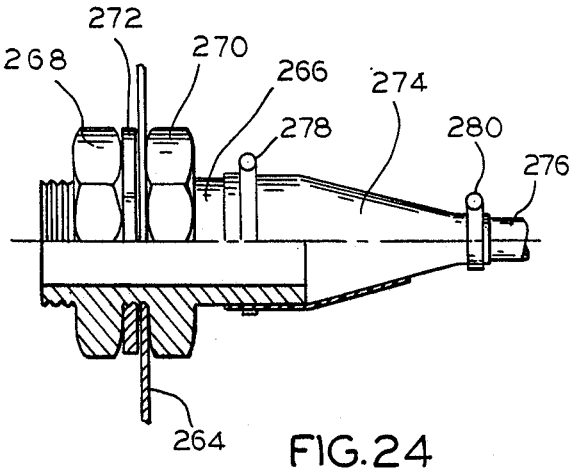
Figure 26:
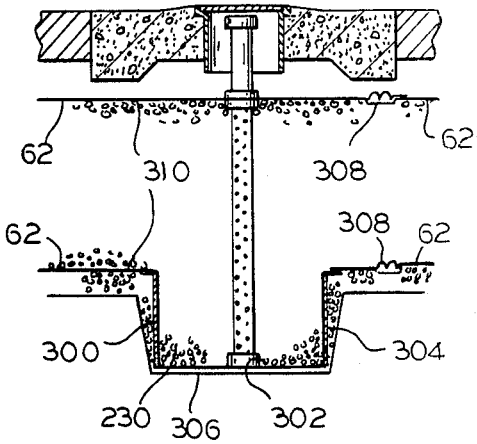
Figure 27:
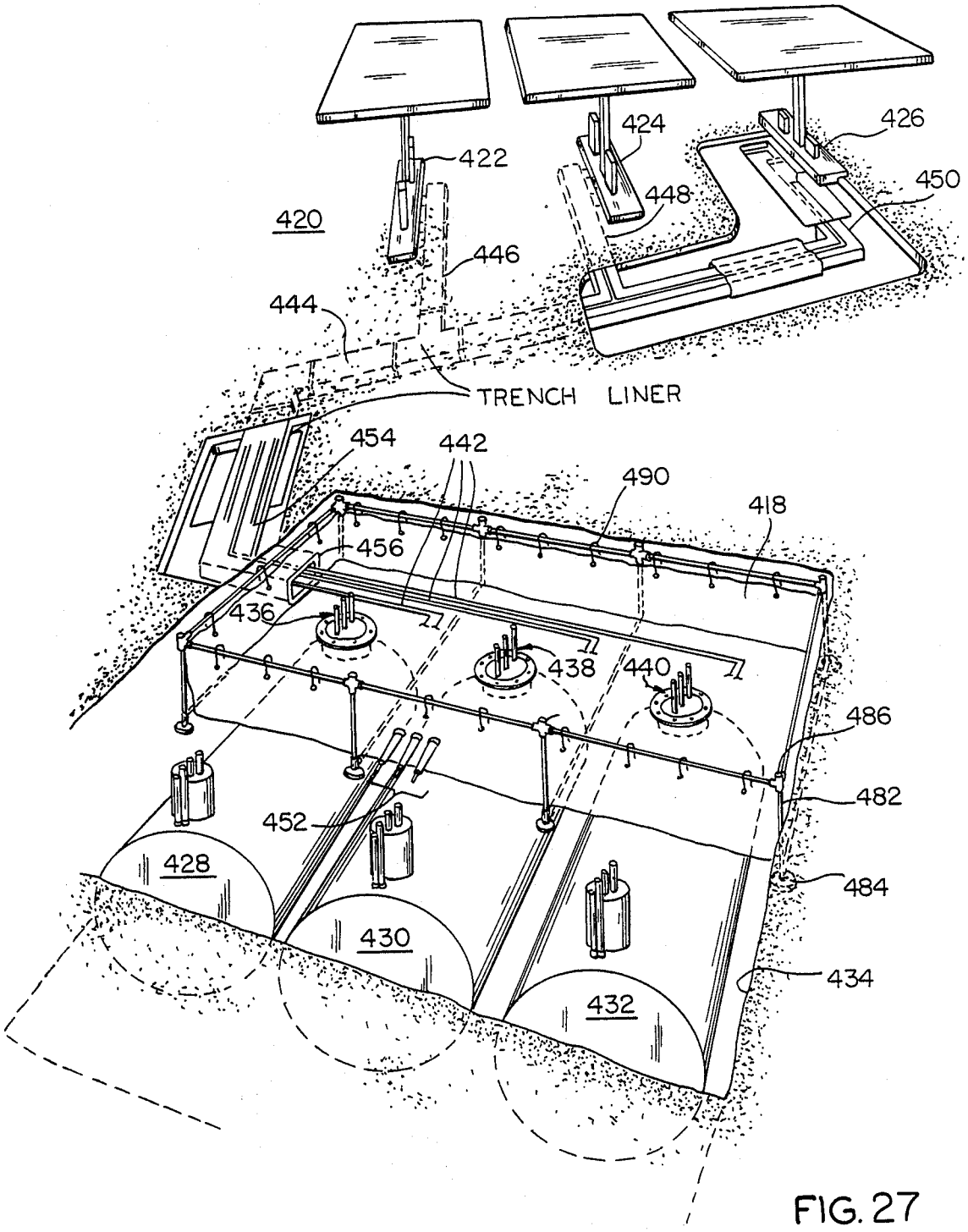
Figure 30:
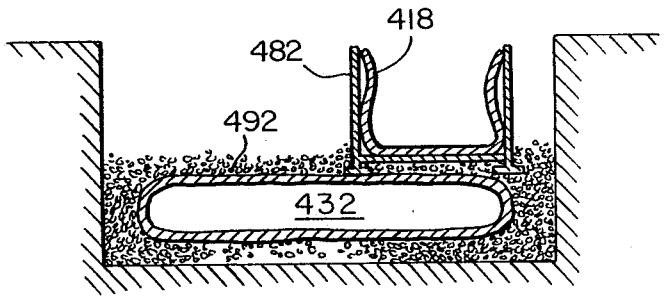
Figure 29:
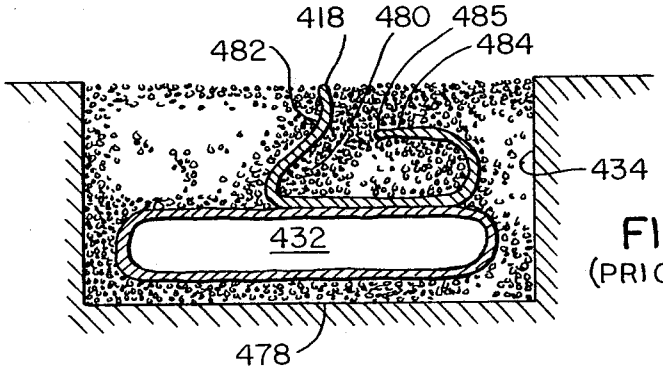
FIG. 29 (PRIOR ART)
Figure 31:
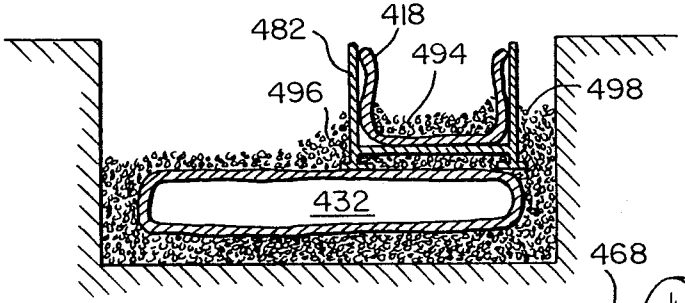
Figure 28:
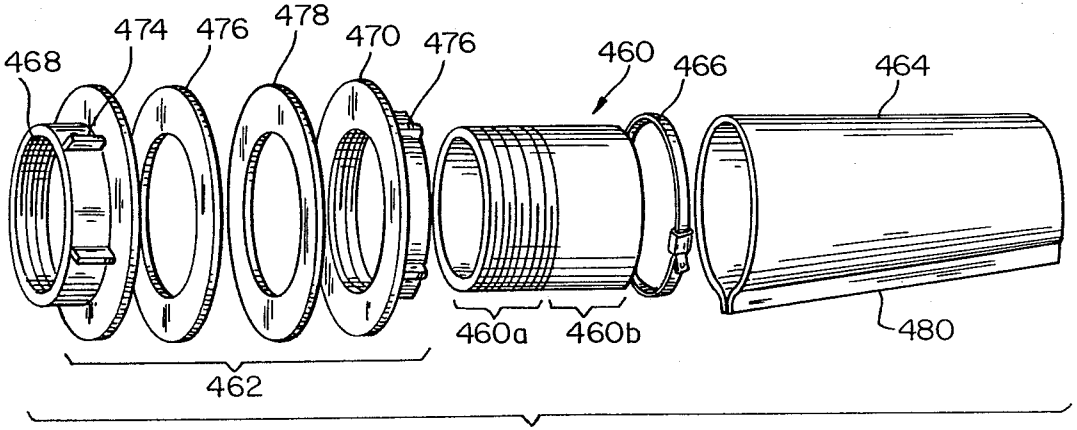

FIGS. 13A—13D are plan and cross sectional views showing a dispensing station with both a local drip pan for collection surface spillage, and with the membrane lined drainage trench leading into the secondary containment pit;

FIG. 14 is a schematic layout of an exemplary gasoline storage and delivery system which might use a double wall tank and an above the tank secondary containment system;

FIG. 15 is a plan view of the inventive containment system of FIG. 14;

FIG. 16 is a cross section of the inventive containment system taken along line 16—16 of FIG. 15;

FIG. 17 is a second cross section, which is taken along line 17—17 of FIG. 15;

FIG. 18 is a monitor station for the embodiment of FIGS. 15–17;

FIGS. 19–21 illustrate how the membrane in FIG. 1 is attached to the top of a double wall tank;

FIG. 22 shows, in cross section, a connector for a trench liner entering a pit containment membrane;

FIG. 23 is a plan view of the connector taken along line 23—23 of FIG. 22;

FIG. 24 is a view, partially in cross section of a connector for a pipe, entering the containment membrane;

FIG. 25 is a cross section of fill and monitor tubes and of a secondary containment system for a double walled tank; and FIG. 26 is a cross section of a monitoring system when there are both upper and lower membranes, as in a trench liner, for example;

FIG. 27 is a perspective view of an embodiment of the inventive secondary container overliner membrane being installed in the area of a fuel delivery system;

FIG. 28 is a perspective view of a bushing for granting entry of structures into a basin formed by overliner membrane;

FIG. 29 is a schematic and stylized showing of problems encountered while installing a prior art overliner membrane; and FIGS. 30, 31 are schematic and stylized showings of the inventive means for and methods of installing the overliner membrane.

The inventive secondary collection system is generally and schematically shown in FIG. 1, where a major secondary collection and containment area (which is hole or pit 30) is connected to a plurality of dispensing areas 32, via a system of radiating trenches 34. A number of tank vent lines are also connected to the major collection pit area 30 via a trench 36. Power lines required to operate pumps or the like, enter pit area 30 via trench 37. Still other trenches may radiate from the pit 30 for these and other reasons.

The major secondary containment and collection pit area 30 is a relatively large pit or hole in the ground designed to receive and bury at least one underground gasoline storage tank. As here shown, there are four such underground tanks 38, 40, 42, 44, each of which may be made in any suitable and known manner, as from a single wall of fiberglass or steel, for example. The manufacturer of such tanks specify how deeply they must be buried, as well as how far apart they must be separated, and how far they must be removed from the surrounding earthen walls and floor. Many governmental regulations state that the pit must be large enough to contain 150% of the fluid in the one largest single wall tank positioned inside the pit. Therefore, the minimum volume of the pit is at least equal to the sum of the volume of all tanks including 150% of the volume of the largest tank.

The dispensing areas 32 provide for a delivery of the gasoline that is stored in the tanks 38–44. For present purposes, the dispension areas may be viewed as four islands 46, 48, 50, 52, each with two pumps, as indicated at 54, 56, for example. Thus, an automobile may be driven between islands 46, 48, for example, stop, and pump gasoline from pump 54 into the gas tank of the auto.

Each of these islands presents the two problems of containing gasoline spilled during its delivery from the underground tank to the dispensing location and of collecting the gasoline spilled on the surface of the earth at the island. The problem of containing fluids delivered to the pump is solved by connecting the delivery pipes through a system of trenches radiating from the collection pit area 30 to the dispensing area. The trenches are lined with a membrane connected to the pit 30. The trench bottoms are graded so that all fluids in them drain into the pit area 30. The problem of collecting local spillage is solved by providing a local drip pan or membrane in a depressed area under the pumps, which depressed area overflows into the trenches.

Dashed lines 60, 62, 64, 66, 68, 70 are used in FIG. 1 to indicate a membrane which lines both the pit and the trenches, and the depressed areas under the pumps. This membrane is continuously joined throughout so that there are no open spots for fluid to leak through.

The material used to make the membrane depends upon the chemical properties of the liquid in the tanks, pipes and pumps. FIG. 2 is a chart originally published by the DuPont company which identifies their various materials and which indicates their preference for materials to be used in connection with any of many different liquids. Other suppliers have similar tables for their products. The preferred material for the inventive gasoline containment includes a DuPont polyester elastomer sold under the trademark "HYTREL". In respect of the "HYTREL" material used as the liner of the second containment system, the inventive membrane is described by the following specifications:

HYTREL REINFORCED SYNTHETIC LINING SPECIFICATIONS: L28105540

| PROPERTY | TEST METHOD | MINIMUM DESIGN REQUIREMENT | HYTREL VALUE |
|---|---|---|---|
| Thickness | ASTM 751 | +/−2%<br>.028 to .030 | .030 |
| Weight | Method 5041<br>Fed. Std. 191a | 26+/−2 oz./sq. yd. | 25.3 |
| Tear Strength | Method 5134<br>Fed. Std. 191a | 200 lbs/200 lbs. | 260/240 |
| Breaking Strength | ASTM D-751<br>Strip Tensile | 350 lbs/250 lbs. | 384/270 |
| Puncture Resistance | FTMS 101B<br>Method 2031 | 300 lbs. | 325 |
| Low Temperature | ASTM D-2136<br>4 hrs., ⅛"<br>mandrel | −50'/no cracking | pass |
| Dimensional Stability (each direction) | ASTM D-1204 | 2% maximum | pass |
| Hydrostatic Resistance | ASTM D-751<br>Method A | 500 psi (min) | pass |
| Blocking Resistance | Method 5872<br>Fed. Std. 191a | #2 Rating | pass |
| Adhesion-ply | ASTM D-413<br>2" per min. | 30 lbs/in (min)<br>On film tearing bond | 35 |
| Dead Load seam sheer strength | (Mil-T-43211 (GL)<br>Para 4.4.4<br>(4 hours) | Must withstand<br>105 lbs./in. @ 70' F.<br>62.5 lbs/in. @ 160' F. | pass |
| Abrasion Resistance | Method 5306<br>Fed. Std. 191a<br>H-18 wheel<br>1000 gram load | 2000 cycles before fabric exposure<br>50 mg/100 cycles max. wt. loss | 8000 |
| Weathering | Carbon-Arc Atlas Weather-o-meter | 3000 hrs. No appreciable changes or cracking of coating | pass |
| Water Absorption | ASTM D-471<br>7 days | 5% max. @ 70' F.<br>12% max. @ 212' F. | pass |

In general, the membrane is resistant to the same classes of chemicals and fluids that are resisted by polyurethanes. Moreover, the membrane does not contain an extractable plasticizer, as do some vinyls, nylon and rubber compounds. The membrane is also resistant to deterioration in most hot moist environments.

The preferred procedure for making the membrane, which has these characteristics and which meets these specifications, is to first provide a loosily woven scrim, approximately 2,000 denier, which is made of polyester fibers. Then, a liquid form of HYTREL is used to coat the scrim on both sides and to fill in the openings between the fibers, with the scrim suspended in a manner so that its fibers become embedded in the middle of the finished sheet thickness dimension. At room temperature, the resulting membrane is resistant to most polar fluids—such as acids, bases, amines glycols, gasoline, oil, hydraulic fluid and the like.

Each of the membrane sections which is used in the pit, trench, and under the pumps is joined to its neighboring membranes sections, in a waterproof manner. For example, the trench liner 62 may be joined to the pit liner 60 by welding, zippers, or the like, at locations 72, 74.

Suitable monitoring stations 76, 78 are provided in the bottom corners of the containment pits. While any suitable sensors may be used, it is thought that the best approach is to provide empty vertical, dry well pipes extending from a point accessible from above ground to a point at or near the bottom of the pit and above the top of the membrane. A dip stick may then be used to measure the depth of fluid in the dry well. The dry well may be perforated so that the vertical composition of the fluid at the bottom of the tank may be analyzed. For example, gasoline floats on top of the water. Therefore the floating gasoline might not be detected if all water in the dry well pipe must enter through its lower end and the floating gasoline never reaches that low level.

Another approach is to put an electronic sensor down the dry well pipe so that a signal is given when the sensor is under water. Known sensors of this type are a relatively simple type having two spacially separated electrodes which experience a current flow between them when they are emersed in an electrolyte.

The action taken in response to a detection of liquids in the pit are irrelevant. Perhaps one response might be to pump out the fluids via the dry well pipes at corners 76, 78. Perhaps another response might be to dig up and replace a ruptured tank 38–44.

Figure 4:
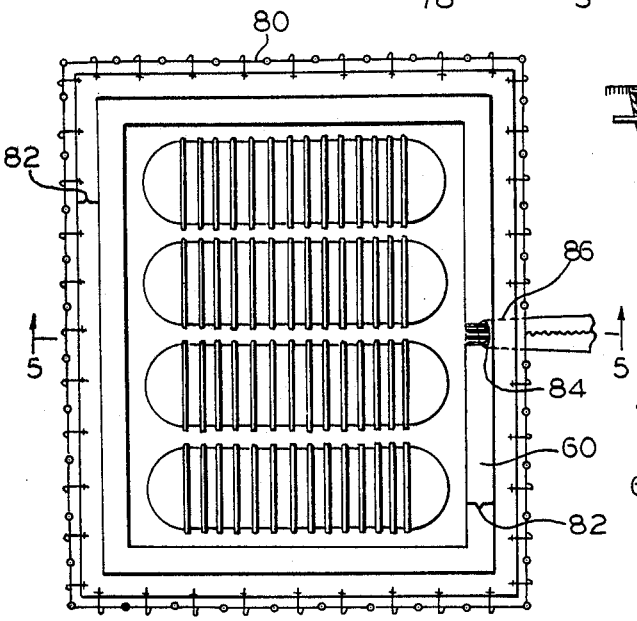
FIG. 4 is a detailed plan view of the secondary containment and collection pit, showing the peripheral anchoring system.
Figure 3:
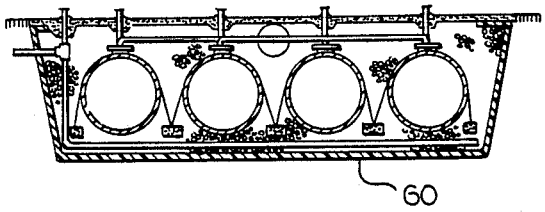
FIG. 3 is a vertical elevation cross section of a secondary containment and collection pit, taken along line 3—3 of FIG. 1.
Figure 5:
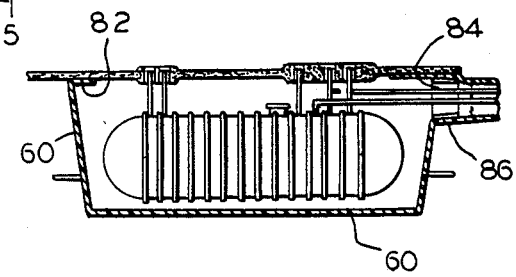
FIG. 5 is vertical cross section of the secondary containment and collection pit, taken along line 5—5 of FIG. 4.

FIGS. 4–6 show details of the secondary containment pit or hole 30. In greater detail, a hole or pit is dug in any suitable size and shape to receive any suitable tank or tanks. Very often, the tanks are a plurality of elongated structures with circular cross section and dome shaped ends, as shown in FIGS. 3–5, in which case, the pit will be generally rectangular.

Means are provided for holding vertical side walls formed by the membrane above the pit bottom during the installation thereof. These side walls may be formed in any suitable manner. For example, the edges of the membrane may be attached to any suitable structure such as a steel frame, a nearby wall, or shoring already in place. In fact, an overhead crane may hold the edges during an installation process. Hereinafter, it will be convenient to refer to all of those and similar means as a perimeter steel cable which is anchored in place by any suitable means.

Figure 6A:
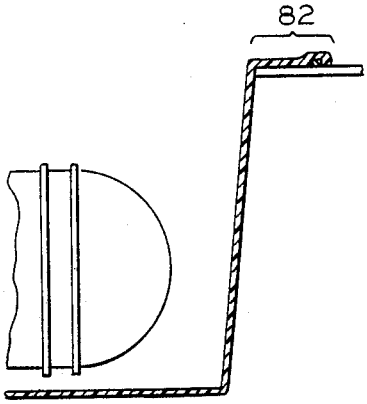
FIGS. 6A and 6B are detail showings of the peripheral treatment of the margins of the pit membrane during filling.

In greater detail, a steel cable 80 is securely staked around the perimeter of pit 30 to provide for reliably anchoring the membrane during its installation. The membrane lines the entire earthen bottom and side walls of the pit, with its edge perimeter 82 folding over the surface of the earth and extending toward the cable 80 (FIG. 6A). The space inside the pit and surrounding the tanks is filled with a ballast, such as sand or pea gravel, which is smooth pebbles about $\frac{1}{4}$ to $\frac{1}{2}$ inch in diameter. The manner of installation and the height of the ballast is established by known manufacturers' specifications.

Figure 6B:
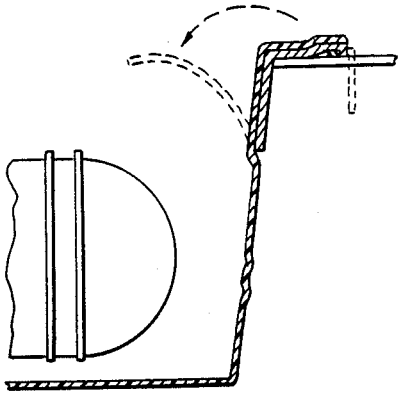

After the ballast is properly installed, the stakes and cable 80 maybe removed (FIG. 6B). Then any excess amounts at the perimeter of the membrane is cut off and the remainder of the membrane is folded over the ballast in the pit and buried.

The side wall portion of the membrane has one or more ports formed therein at any point or points which must be entered. For example, as manufactured, a circular opening 84 (FIGS. 5, 6) is formed in the membrane 60, and joined to a plastic sleeve 86 in any suitable manner, such as by welding. In appearance, the sleeve 86 may look like a top hat without a crown and with the brim attached to the membrane as by welding, compression fitting, zippering, or the like. The sleeve 86 and the pit liner 60 are made of the same membrane material.

After the sleeve and membrane are brought together, the union thereof may also be reinforced, as by one or a pair of annular metal flange plates (see FIGS. 22, 23) which may be bolted over the brim of the top hat, if desired, and on opposite sides of the membrane and sleeve. These flange plates may be used in conjunction with other suitably shaped metal members. Since the port 84 is relatively high and near the top of the pit, the bolt holes through the membrane are above any level of fluid containment which is likely to occur. Suitable sensors may be located in the area between 72 and 74 (FIG. 1) to monitor the collection of fluids in the trenching system. These sensors will inform the user as to whether a leak has occurred in the trench.

Figure 7B:
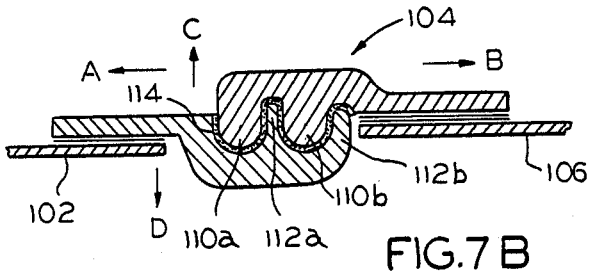
FIG. 7B shows a plastic zipper used to join and close sections of the liner membrane.
Figure 7A:
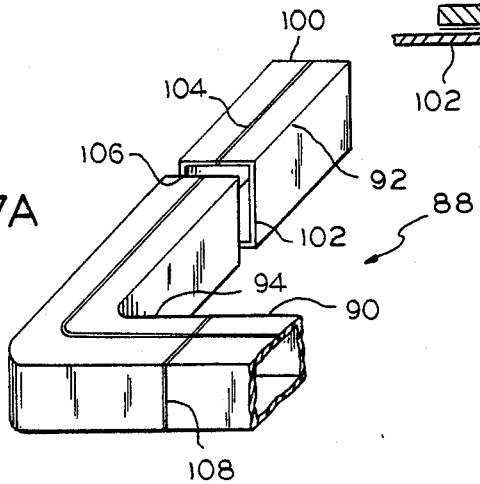
FIG. 7A is a detail showing of membrane sections used for creating a trench liner.

The trench liner 88 is seen in FIG. 7A as including two exemplary straight sections 90, 92 and a preformed curved section 94. This curved section is here shown as a right angle elbow, such as might be used at corner 96 (FIG. 1). It could, of course, also be a 45' elbow as used at 98, or any other suitable shape, including radius curves, S-turns, or the like. The trench liner may be used for any suitable purpose, such as an enclosure for delivery pipes, electric lines, vent pipes, or the like. Section 90 could also represent the sleeve 86 (FIGS. 4, 5) which is welded to the membrane port during manufacture.

Each section 90, 92, 94 of the trenching material is a separate sheet of membrane material which has a zipper half attached to each of its edges. Thus, for example, liner 92 is a rectangular piece of membrane material with a first zipper half 100 extending along one end, a zipper half 102 extending along the opposite end and a pair of zipper halves 104 extending along each of its opposing sides. A mating zipper half 106 extends along a side of elbow section 94 to confront the zipper half 102. Thus, when the zippers 102, 106 are zipped together and closed against each other, the sections 92, 94 are joined together. Likewise, when a zipper is closed at 108, sections 90, 94 are joined together. After the trench installation is completed and the liner is ready to close, the zippers along the two opposing sides of the membrane are closed, as indicated at 104. Thus, the top of the liner is now closed against the entry of surface water.

Figure 8:
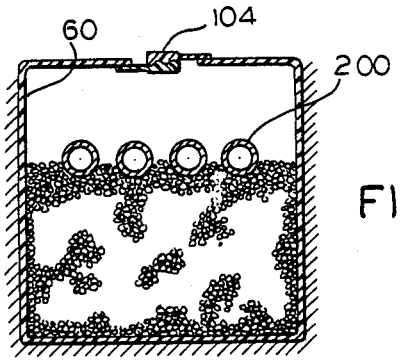
FIG. 8 is a cross sectional view, taken along line 8—8 of FIG. 1, of a trench with the membrane closed around ballast supporting fluid delivery pipes.

FIG. 8 is a cross section showing the trench and its membrane liner. The outside of the trench, indicated by short cross hatching lines 107, may be the earth, for example. Inside the trench, the membrane 101 rests on and is supported by the earthen walls 107. Inside the membrane, a ballast 109 (such as pea gravel) is spread to support the delivery pipes 111 extending from the underground tanks to the dispensing points.

The entire trench area is surrounded by the membrane 101 so that any fluid is contained therein. The trench and ballast are graded so that all liquids inside the membrane are drained into the pit. The zipper 104 prevents outside fluids (such as rain water) from entering the containment system.

The details of the zipper, per se, are seen in FIG. 7B. In greater detail, each of the confronting edges of the membrane panels is attached and sealed to individually associated zipper halves. When these zipper halves 102, 106 are zipped together by means of a roller or slide closure, there is a leak resistant seam. Any suitable zipper closure means may be used if it provides such watertightness and airtightness and if it is easy to open or close in almost any weather and under almost any environmental conditions. It is also desirable to use a closure which is maintenance free.

One example of such a closure is a sectionalizing plastic zipper which provides for a quick and easy closure by using a simple hand held roller tool which presses one part into the other. More particularly, the zipper or slide fastener 104 comprises a pair of continuous beads 110*a*, 110*b*, 112*a*, 112*b*, of interlocking plastic channels formed along each confronting edge 102, 106 of the two panel flaps. These beads also form confronting coves on one flap, which receive upstanding and complementary contoured beads on the other flap. Thus, the two complementary beads are forced into the opposing coves. This forces the coves to spread apart to receive the opposing beads. Then, responsive to plastic memory, the sides of the coves come together, embrace, and hold the opposing beads in a tight fit. One advantage of this type of zipper is that it is relatively maintenance free. In a conventional zipper, sand or dirt can collect in the teeth if used under the present conditions. In the preferred sectionalizing plastic zipper sand, dirt or debris should not collect between the beads and coves, and further, there is no great problem if they do so collect.

Another characteristic of this type of zipper is that it is almost impossible to pull the two mating zipper halves apart by forces exerted in the directions of the arrows A-B. However, the zipper easily separates responsive to forces in the directions of the arrows C, D.

Most of the junctions between the various membranes are never opened after they are once installed. However, a few may require occassional opening for access to the enclosed equipment. For example, in FIG. 1, it may be necessary or desirable to gain access to equipment in trench 66 if the dispenser 56 is replaced. On the other hand, it is doubtful that it would be necessary to open the zipper at 72 or 74. Thus, it should be possible to open some selected zippers, but not the other zippers.

Accordingly, as shown in FIG. 7B, a sealant 114 is placed between the zipper halves when a seam is not to be reopened. Conveniently, the sealant may be painted on the zipper halves immediately before it is closed.

One of the sealants which has been used in such zipper installations is sold, by the USM Corporation of Middleton, Mass. 01949 under the trademark "BOSTIK". The manufacturer describes this sealant as a two-part, self-curing urethane adhesive for bonding urethane rubber, foams, fabrics, neoprene, and the like. It is used as a seam adhesive for urethane-coated fabric, as in the manufacture of inflatable escape chutes, canopies and protective clothing. Also, it is used to cement solid urethane rubber to itself. This sealant exhibits excellent resistance to water, oil, gasoline, detergents and dry cleaning solvents. The addition of a cross linking agent, improves the adhesion and develops the outstanding resistances of the adhesive. The USM Corporation describes this sealant, as follows:

| PRODUCT | BOSTIK 7376 | BOSCODUR NO. 4 |
|---|---|---|
| Color: | Clear | Brown |
| Base: | Urethane | Isocyanate |
| Solvent: | MEK/Toluol | BOSTIK 3309 (MEK) |
| Flast Point (TOC): | 35′ F. (2′ C.) | 52′ F. (10′ C.) |
| Lbs. per Gallon: | 7.3 (.87 Kg/liter) | 8.91 (1.1 Kg/liter) |
| Consistency: | Medium Syrup | Thin Liquid |
| Viscosity (Brookfield): | 1300–2000 cps. | — |
| % Solids (Approx.): | 21–24% | 68–70% |
| Mixing Ratio: | 25 volumes | 1 volume |
| Pot Life (Mixed): | 12–16 Hours | |
| Shelf Life (Unmixed): | Six Months stored @ 60–80′ F. (16–27′ C.) | |

Figure 9:
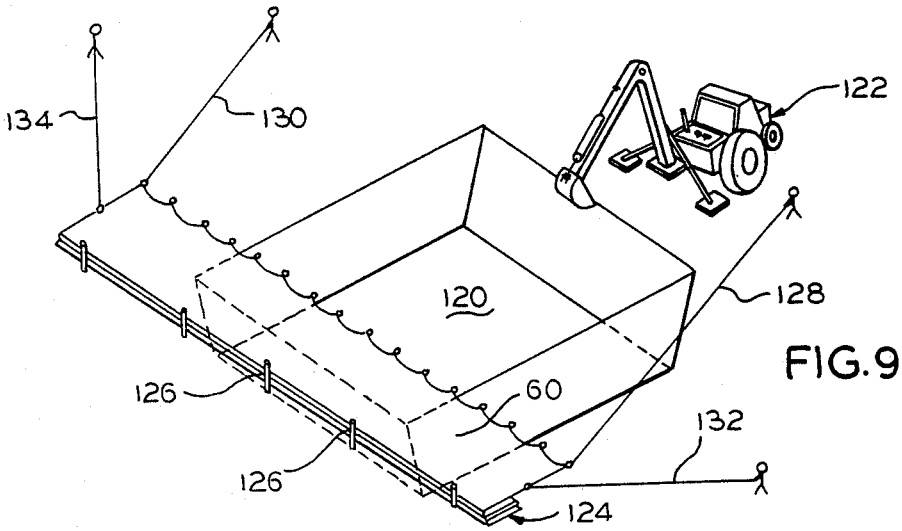
FIG. 9 is a generalized and schematic view of the process used for installing the container.

The method of installing the inventive secondary containment system is shown in FIGS. 9–13. In greater detail, any suitable means digs a hole or pit 120, from the earth, in any desired shape and size. As shown in FIG. 9, the hole or pit 120 has been dug by a back hoe 122. The membrane 60 is a flat sheet, in a size which is large enough to completely line the bottom and side walls of the pit 20.

After the membrane sheet is finished, it is accordion folded (as indicated at 124) in the factory and thereafter transported to the site. There, the entire length of one edge of the membrane sheet is securely staked down along one side of the pit, as indicated at 126. As will be explained below in greater detail, the edge of the membrane may be secured in place by snapping it onto a steel cable which is anchored to the earth. Then, primary tethers 128, 130 are attached to the free edge of the membrane sheet, and it is pulled over the pit 120. Secondary tethers 132, 134 are attached to the edges of the membrane to guide and direct as it is pulled over the hole. The membrane settles into the hole, covering its earthen bottom and the sides.

In greater detail, the sequential steps for making this installation are seen in stop motion FIGS. 10A–10D. First (FIG. 10A), the pit 120 is dug and then a perimeter steel cable 136 is staked down around the entire perimeter. The stakes, such as 138, are long enough and far enough from the edges of the pit to resist removal by any anticipated pulling on the membrane responsive to any force strong enough to meet occupational and health standards as set by various government agencies.

After the steel perimeter cable 136 is secured in place, the membrane 60 which is accordion folded at 124 is laid along one side of the pit and snapped to the adjacent length of the cable 136. Preferably, the attachment begins by snapping a marked center of the membrane to the center of the steel cable and then attaching from that center, outwardly toward the opposite ends of the membrane.

Figure 10B:
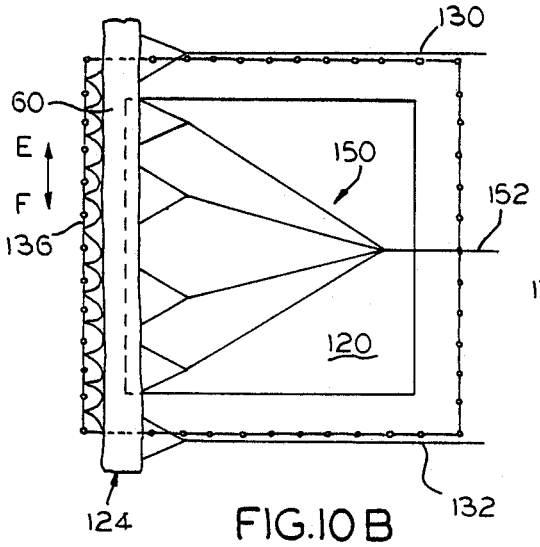
Figure 11A:
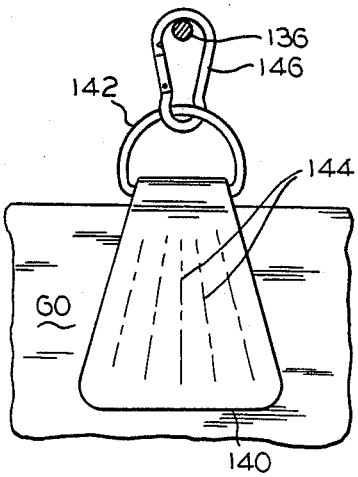
FIG. 11A is a detailed disclosure of a D-ring installed on the edge of membrane to anchor it during, and perhaps after installation; also

FIG. 11A shows details of snap-on fasteners which are attached along the edges of the membrane sheet 60, perhaps at five foot or other suitable intervals. Each fastener comprises a butterfly shaped member 140 made of the membrane material. A D-ring 142 is threaded through the butterfly material, which is then folded in half, and cemented or welded to the opposite side of the membrane 60. The butterfly shape spreads the stress of a pull on the D-ring across a wider area of the membrane, as indicated by the dot-dashed family of stress lines 144. A snap-on fastener 146 is passed through the D-ring 142 and snapped over the cable 136. If the stakes 138 and the snap-on fasteners 146 are separated by five feet intervals, for example, the membrane 124 may slide freely back and forth (directions E, F, FIG. 10B) for five foot distances. If the membrane must slide more than five feet, in this example, the snaps may be relocated on an opposite side of the stake. Thus positional adjustments may be made during installation of the membrane and later during the installation of ballast in the pit.

A truss of tethers 150 is attached to the snaps on the side of the membrane 60 which is opposite to the staked down side. The cable 152 may then be attached to the back hoe 122 (FIG. 9)—or to any other suitable vehicle—which pulls the truss of tethers 150 and, therefore, the edge of the membrane 60 across the pit. Depending upon the total weight of the membrane, either workmen or other vehicles may pull on tethers 130, 132 (FIG. 9) to keep the membrane traveling in a straight line.

Figure 10A:
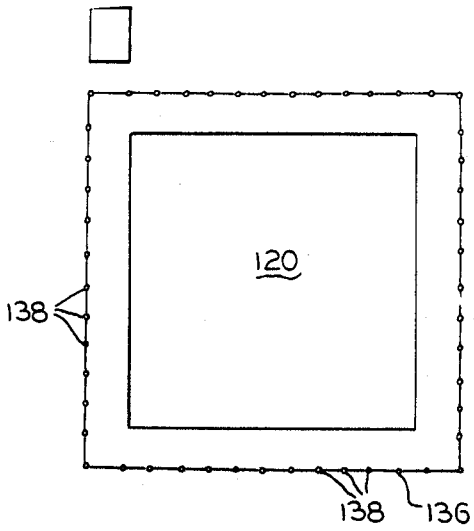
FIGS. 10A –10D are stop motion, schematic showings of four successive steps in the installation process.
Figure 10C:
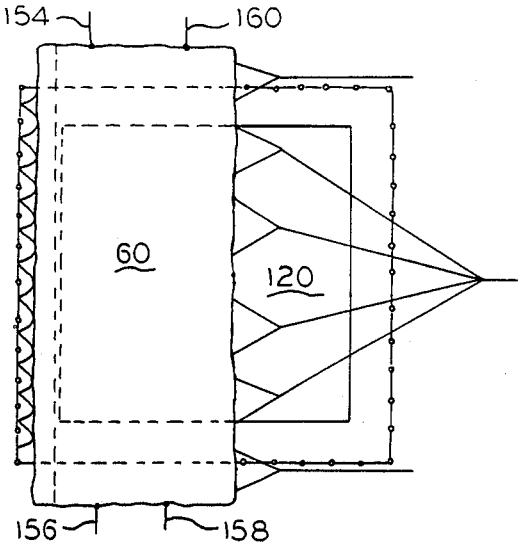

In FIG. 10C, the membrane 60 has been pulled from its accordion folded position of FIG. 10B, across about one half of the open pit 120. As the membrane 60 spreads, four or perhaps more tethers 154–160 emerge from the unfolding membrane. These tethers were attached to the membrane and placed into its accordion folds, in the factory. As they emerge during the unfolding, these tethers 154–160 are picked up and held by workmen. If need be, these tethers may be pulled to straighten the course of the membrane as it is being drawn across the pit.

The snaps 146 are clipped onto the steel perimeter cable 136 at appropriate times throughout the membrane deployment and spreading process. Therefore, the sides of the membrane will not slip into the pit.

Figure 10D:
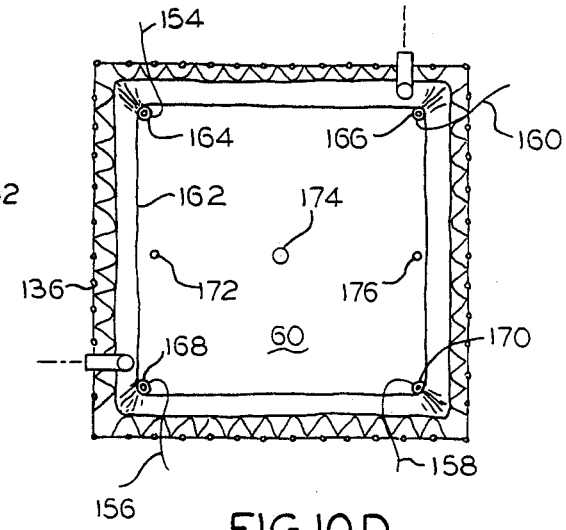

In FIG. 10D, the membrane 60 has been spread across the entire top of the pit and has settled into it. The entire perimeter of the membrane has been snapped onto the cable 136. In the bottom of the pit, a brightly colored marker 162 is formed on top of the membrane to outline the area of the membrane which should lie over the pit floor or bottom. The marker 162 may be a rectangle of bright yellow type, for example. Thus, it is completely apparent to a workman at the top of the pit whether the membrane is properly centered on the bottom of the pit.

At least four, and maybe many, D-rings are attached to the bottom of the membrane, as at positions 164–176, for example. In general, these positions are selected in the factory, at the time of manufacture.

Figure 11B:
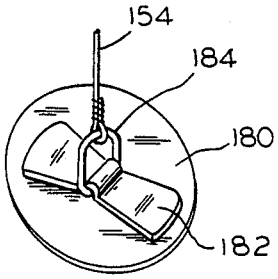
FIG. 11B is a detailed disclosure of a D-ring installed on flat surface of the membrane to assist in centering it during the installation thereof.

The details of each of these D-ring installations is seen in FIG. 11B. There is a large, preferably round, patch 180 which covers enough area on the membrane 60 to preclude it from rupturing under normally anticipated membrane strains. Sewn and cemented to patch 180 is a butterfly member 182 with a D-ring 184 captured in its middle. Patch 180 and butterfly member 182 are made of the membrane material. The tether (such as 154, FIG. 10D) is tied to the D-ring 184. One of these units (FIG. 11B) is attached to the membrane 60 at least at each of the four corner locations 164–170, and perhaps, elsewhere, depending upon the size and shape of the membrane.

It should now be apparent that once the member 60 has settled into the hole, the tethers 154–170 (and perhaps others, not shown) are pulled until the membrane is centered and the colored marker 162 is properly positioned along the edge between the earthen floor and the side walls. With the membrane in its designed position and with the entire perimeter of membrane 60 clipped onto the steel perimeter cable 136, the pit walls are sufficiently shored to enable workers to enter the pit once the bottom is secured in place by ballast.

Figure 12:
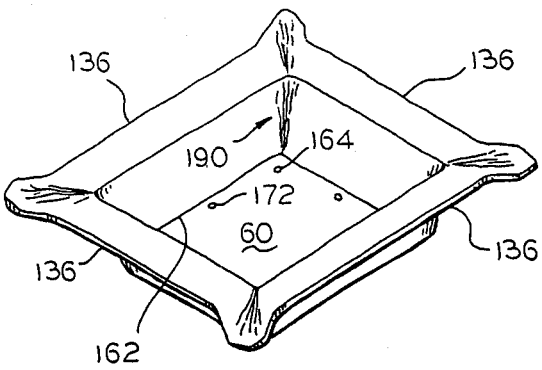
FIG. 12 is a disclosure of the installed collection and containment pit or hole liner per se.

FIG. 12 is an idealized showing of the membrane, per se, as it might appear, divorced from the surrounding earth. The upper edge 136 of the membrane is at the earth level and the bottom is, perhaps, ten or fifteen feet down in the bottom of the pit. This means that the bottom may be substantially below the level of the underground water table, in some particularly wet areas. If so, there may be times when it would be desirable to place at least some water in the bottom of the pit to equalize the hydrostatic pressure on opposite sides of the membrane. Care must be taken not to have fluid in the pit so deep that an empty tank might float upwardly.

Also, it is possible that there might be a pin hole, or the like, in the membrane, which would allow water to leak into the bottom of the pit.

Neither, a high water table nor a pin hole would cause problems since hydrocarbons float on the top of water. Therefore, if water enters the membrane, any gasoline in the pit floats to the top and does not escape from the bottom, under these partially water filled pit conditions.

If migratory electrical currents are likely to be a problem, sacrificial anodes may be included in the ballast, or lowered down dry wells. These anodes are known to the art. In general, a material such as zinc or aluminum has a molecular charge which is high enough to attract the migratory currents. Thus, the zinc or aluminum attracts the currents and disintegrates, thereby preventing currents to other and desirable metal parts which might disintegrate.

There is an excess of membrane material since it is a flat sheet and is not form fitting. Therefore, there tends to be a bunching of the membrane in the corners of the pit, as schematically indicated at 190, and elsewhere in FIG. 12. Thus, if the pit is longer or shorter than planned, there is a more or less bunching at any given corner or corners, but the membrane still fits the interior of the pit.

Also, random slackness may occur at many places along the length of the walls. Thus, if the earthen walls behind the membrane have any unevenness, say a dished area with slight projections on opposite sides thereof, the membrane is not tautly stretched over the dish and between the two projections, to be unduly stressed by a backfilling of the ballast material, compacted into the dished area. On the other hand, since the perimeter of the membrane is only snapped periodically onto the steel cable 136, the slack membrane material may be pulled back and forth to fit into dished areas or over projecting areas. Thus, the workmen can feel the earthen wall behind the membrane. When a condition which could cause a tightness in the membrane is detected, the perimeter of the membrane may be slid freely along steel cable 136 to bring in looseness of membrane material from wherever it may appear, and if need be, from the corner bunching, as at 190. In any event, a workman with even a relatively low experience level is able to feel the earthen wall behind the membrane and anticipate where to place slack membrane material.

The procedures for filling ballast (pea gravel) into the pit of FIG. 12 are to first install the membrane, as explained above. Then, after the bottom of the membrane is centered in the pit, as explained in connection with FIG. 10D, the dry well pipes are installed in the corners of the pit to give access to the bottom of the pit for monitoring the collection of fluids and for pumping such fluids out of the containment system. Pea gravel is then dumped into the bottom of the pit and over the top of the membrane, and around the dry well pipes. After a predetermined amount of pea gravel is in place (about 12" depth), the bottom of the membrane is sufficiently anchored so that it is safe to put down ladders for workmen to enter the pit. There is not so much slack in the side walls of the membrane that a side wall collapse could result in a landslide avalance to bury a workman in the bottom of the pit. Even if a cave in should be powerful enough to eventually rupture the membrane, there would be enough delay time before the rupture to enable a worker to move to an opposite side of the pit. Thus, the various occupational safety standards are met.

The next step in the process of constructing the inventive system is for the workmen to rake the pea gravel to a predetermined grade and depth. The manufacturer of the tanks set out specifications which insure stability, drainage and support of the tank walls. In general, the tanks are placed in a position so that all fluids settle into one end or into a sump so that the tank may be pumped dry.

Next, more pea gravel ballast is placed in the pit and tamped under and around all over hanging tank walls. For example, if the tank has a circular cross section or a dome shaped end, or the like, the underside of such curvature must be fully and completely supported by the tamped ballast, in a known manner.

When the level of the pea gravel ballast reaches the widest parts of the tanks, there is less danger that a void might be left to cause a rupture from a lack of adequate tank wall support. Then, the pea gravel or ballast filling may proceed more quickly. Insofar as the membrane is concerned, it is important to establish an equilibrium of supporting forces on opposite sides of the membrane. Thus, care is taken to be sure that the pea gravel ballast flows into dished areas, over projections, etc., of the earthen wall behind the membrane.

Figure 13A:
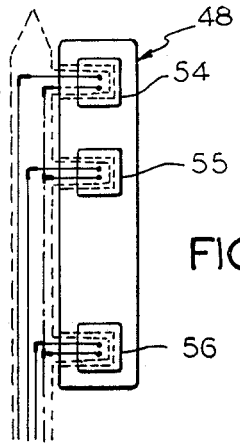

FIGS. 13A–13D show a continuation of the secondary containment system into the dispensing area. For example, FIG. 13A shows a plan view of a dispensing area 48, taken from FIG. 1.

There are two kinds of spills which should be contained in dispensing areas. First, there is the relatively small spill which occurs when someone accidentally lets an automobile gas tank overflow or when someone absent mindedly squeezes the delivery trigger at the dispensing nozzle of a pump. The relatively small amount of gasoline which falls on the ground, as surface fluid, may be collected and evaporated locally. Second, a fuel delivery pipe (as shown at 200) may rupture in the delivery system. Then, the system pumps may begin to deliver a substantial amount of fluid through the rupture and into the trench. The inventive system is designed to contain these two kinds of spills in two different ways.

Figure 13B:
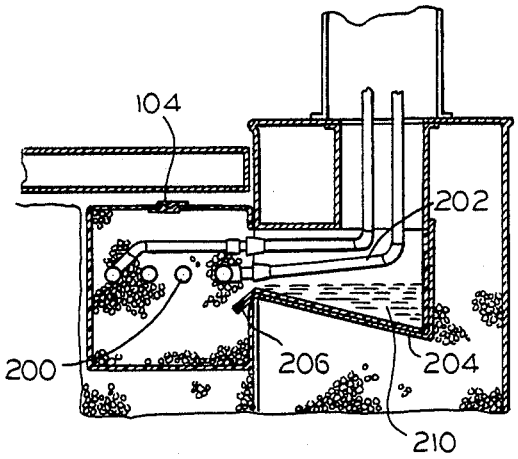
Figure 13C:
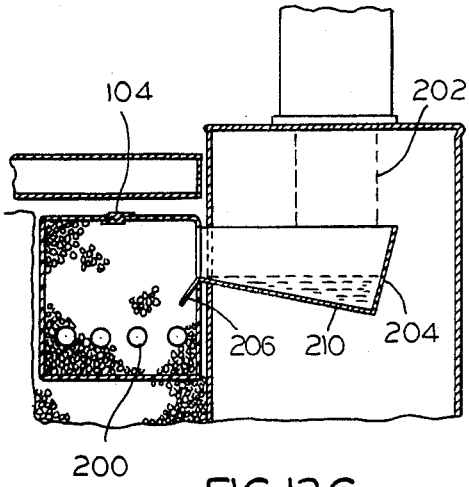
Figure 13D:
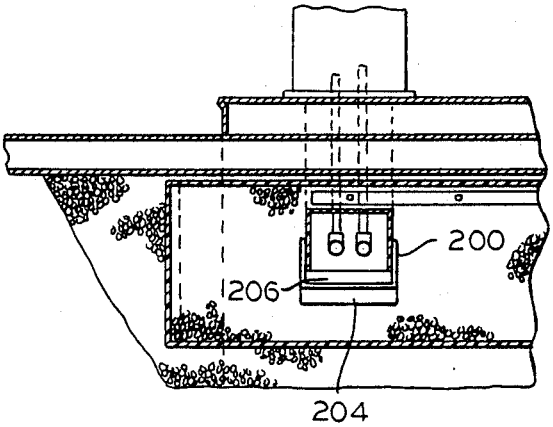

As shown in FIG. 13B, the inventive membrane liner 202 surrounds the delivery pipes and a pea gravel ballast supporting the pipes. The membrane liner 202 is closed on the top by zipper 104. The entire trench system is graded so that any fluid inside the trench membrane flows back toward the collection and containment pit 30. Since this area under the pumps is the highest in the drainage system, the level 204 is referred to herein as a depressed area. Thus, the more important spills involving large amounts of gasoline are contained by returning them to the large capture, collect and storage area of pit 30.

To collect the small spills, a sheet metal drip pan covered by the membrane material 204 (FIGS. 13C–13D) is positioned in the depressed area under the pump and is formed and supported by the ballast to slope downwardly and away from the trench. Any surface spill in the dispenser area seeps through a ballast around the pumps and into the drip pan. The highest point on the bottom of the downwardly sloping pan 204 ends in a flap or overflow chute 206, which projects into the trench. If any spilled fluid collects in the drip pan and raises to the level of flap or overflow chute 206, it overflows from the depressed area into the trench liner, from which it flows through the trench liner and into the pit. The sides and back of the drip pan rise to a level which is higher than the overflow chute or flap 206. Therefore, no liquid can flow over the upper edges of the drip pan. As a result, up to a few gallons of surface spill 210 (FIG. 13C) flows to the low back end of the drip pan 204, where it collects and evaporates. Thus, the small surface spill never reaches the inventive containment system. A large spill overflows chute 206 and returns to the pit.

A second kind of tank 220 (FIGS. 14, 15) has double walls so that the outer tank wall contains any spill of fluid through a rupture of the inner tank wall. Therefore, the double wall tanks are simply buried in the earth. There is no need to line the bottom of the hole containing a double walled tank.

On the other hand, there are a number of points on the top of the tank where leakage may occur. There are covers 222 bolted onto the top of the tanks to give access to the interior of the tank. There are various pipes 224 which may enter the tank, such as fill pipes or vents, for example. The trench liner 98 may enter the membrane 226 and return spilled fluid or fluid leaking from the pipes. Thus, there is a need for a secondary containment system, to protect part of the system other than the tanks.

It is less expensive to place the membrane near the top of the hole than it is to place it in the bottom of a hole which is dug to bury the tanks. Accordingly, the membrane 226 is shown as being above the top of the tank but below the parts which may leak and spill fluid (e.g. pipes, manhole covers, etc.).

FIG. 15 illustrates various features which may be built into the system. For example, one or more sumps 228 may be located in the dispenser area or along the trench to receive a monitor station 230. Monitor stations 230 may also be located in the main containment area. Each of these monitors is located at a low point where fluids may collect.

In greater detail, the tank 220 (FIG. 16) is placed in an unlined hole 232 and is supported by a suitable ballast, such as pea gravel. In this case, the tank slopes downwardly toward the right (as viewed in FIG. 16). A peripheral drainage ditch is formed with a downward slope in the back fill surrounding the tank. The membrane 226 is draped over the tank and down into the drainage ditch, thus forming a sump 234 into which any liquids may drain.

The monitoring system 23 (FIG. 18) is in the location of sump 234. Preferably, the monitoring system includes a slotted vertical pipe 236 that enables the various strata of the fluid in the sump to also appear in the pipe. Thus, it is possible to detect both the light fluids floating on top and the heavy fluids settled into the bottom of the sump. The entire area contained within the membrane 234 is filled with pea gravel, which also supports and stabilizes the pipe 236.

The top of pipe 236 is covered by an suitable cap 238 and is protected by a cast iron manhole cover 240. Thus, the manhole cover 240, and cap 238 may be removed and any suitable equipment may be lowered into pipe 236 to monitor the fluid collected there or to pump the fluid out of the containment area.

FIGS. 19–21 illustrate how the upper level (above the tank) membrane is attached to the tank. In greater detail, the double wall tank 220 has a man way opening 242 covered by a manhole cover 222, which is conventional. A second manhole cover 246 (FIG. 20) may be positioned above cover 244 and at pavement level to give access to the tank. The manhole cover 244 is bolted (as at 248) to opening member 242, around the periphery thereof.

A compression ring 250 is positioned above the membrane 226, and a second plate 252 is positioned under the membrane. Therefore, bolts 248 compress the membrane 226 between metal rings 252, 250. Pea gravel or other suitable fill material 256 is positioned between the membrane 226 and the top of tank 220 in order to support and protect the membrane 226.

It should now be clear that the upper membrane used for double walled tanks has openings it, but those openings are attached to the tank in a waterproof manner.

FIGS. 22, 23 show how flexible connections (such as the trench liner connector member 86) are made to the membrane. More particularly, circular, rectangular or similar metal plates 258, 260, with L-shaped cross sections are placed on opposite sides of the membrane 226 and are bolted into place, as by bolt 262, for example. A calking compound is spread between plates 258, 260 and the membrane before the bolts are secured in place. The flexible trench liner connector membrane 86 is welded or otherwise attached at 264 to the upstanding part of the L-shaped cross section.

Pipes are coupled through the membrane 264 as shown in FIG. 24. In greater detail, a threaded nipple 266 passes through the membrane and is clamped in place by two nuts 268, 270 positioned on opposite sides of the membrane, with a sealing gasket 272 compressed against the inside surface of the membrane. Stainless steel compression rings 278, 280 clamp a flexible boot 274 around the nipple 266 and a pipe 276. A calking compound is laced between the inside surface of the boot and the outside surface of nipple 266 and pipe 276.

FIG. 25 shows how the fill pipes 224 (FIG. 14) may be protected. The double wall tank 220 is normally constructed in a manner which enables the fill pipe to be secured thereto, as by a suitably threaded opening at 282. The invention provides a threaded nipple 284 which fits into this opening. A suitable rigid pan 286 with upstanding peripheral walls is coaxially welded or otherwise attached in any suitable leakproof manner to the nipple 284. At 290, the bottom edge of tubular sleeve 288 of the membrane material is heat welded to the upstanding wall of pan 286. The upper end of tubular sleeve 288 is anchored in place by the back fill of pea gravel, or the like, which fills the space above tank 220.

The fill tube 224 is joined to the threaded nipple 284 by a coupler 292 of conventional design. A vertical monitor tube 295 is positioned inside the tubular sleeve 288 to give access to the bottom of the hole. This tube 295 is slotted periodically along its entire length so that any strata composition of fluid collecting in the hole is accurately reflected by the fluid being monitored inside the tube.

As here shown, a pavement 296 covers the top surface of the earth. A manhole cover at surface level, gives access through the pavement to the tops of the fill and monitor tubes.

The construction of sump monitor points 230 (FIG. 15) is shown in FIG. 26. Such a sump monitor may be located at any place in the system where fluids may collect. As here shown, there is a trench liner 62 so that the sump 23 is here pictured, by way of example, as being located along the run of pipes extending from the tanks to the dispensing areas.

The bottom of the trench is dug to include a deeper sump in which fluids may collect. A foam plastic tube 300 is set into the sump, and a factory constructed, made to fit liner 302 is fitted down and into the foam plastic tube 300. The area 304 in the sump which is outside the plastic foam tube is back filled with pea gravel to provide support. Additional pea gravel 306 is placed inside the liner to stabilize its position. Then, the sump liner 302 is attached to the trench liner by means of zippers 308, 310. A suitable vertical monitor tube 320 extends from near a manhole cover 322 through an upper membrane 324 and into the bottom of the sump. At the point where the monitor tube penetrates the upper membrane 324, a compression fitting 325 is placed on the tube above and below the membrane 324. This fitting holds the upper membrane sealed to the tube 320 in a waterproof manner. The manhole cover 322 may be removed to give access to the upper end of the tube 230.

FIG. 27 shows an exemplary location where the invention is used in order to install an overliner membrane 418. This location is shown, by way of example as a filling station 420 having three islands 422, 424, 426 where gasoline dispensing pumps are located. Three underground tanks 428, 430, 432 are buried in a pit 434, dug into the earth. Each tank is assumed to have double walls or another self protection device which eliminates a need for an underlining. However, each of these three tanks has fill pipes 436, 438, 480 which represent points when fluid may be spilled, as the tanks are filled.

Also each of the service island pumps 422–426 receives its fuel from the tanks via delivery pipes extending through trenches 444–450. Anyone of these delivery pipes could rupture or leak. Each user of the pumps may perform some careless act which may result in spillage at the pumps that could leak into and seap through the earth. Therefore, a membrane lines depressed areas under the pumps.

Other apparatus may also require access into the basin formed by the inventive overliner membrane. For example, this apparatus might be represented by electrical wiring 452 which could extend to pumps associated with the individual tanks. These wires must be able to enter the membrane basin without providing a path for pollutant fluids to escape from the basin and into the environment.

The delivery pipes extend through a trench system 444–450 which is lined with a membrane (as at 454). This trench membrane 454 extends out to and in a depressed area under the entire area around the service islands where spillage may occur. Next, a ballast is poured over the membrane and around the pipes. When the ballast completely covers the pipes, the trench membrane 454 is wrapped around it and sealed onto itself. The membrane 454 surrounding the pipes is joined to the overliner containment membrane 418 in a leakproof manner by a bulkhead clamping plate 456. The trench system is graded so that any leakage of fluids from the pipe system or spillage in the service areas 422–426 drains through trench membrane and into the overliner containment membrane 418.

FIG. 28 shows a bushing for enabling the entrance of apparatus, such as wires, pipes, etc. at 452 (FIG. 27). The principal elements of the bushing of FIG. 28 are a cylindrical tube 460 which is threaded on one end 460*a* and smooth on the other end 460*b*, a pair 462 of flanges and resilient washers, a sleeve 464 of membrane material, and a hose clamp 466.

The flanges 468, 470 have internal threads which mate with the threads 460*a* on the cylinder 460. A plurality of projecting fins, such as 474, 476, extend from the hub of each flange in order to facilitate a tightening of the flanges when on the cylinder 60. A pair of resilient washers 476, 478 fit over the threaded end 460*a* of cylinder 460 and are secured between the end faces of the flanges. The membrane 418 has a hole (not shown) which also fits over the threaded end 460*a* of the cylinder 460 and between the resilient flanges 476, 478. Thus, when the flanges 468, 470 are tightened against each other, there is a watertight seal between the membrane 418 and the bushing of FIG. 28.

The membrane sleeve 464 is a sheet of membrane material wrapped upon itself and sealed at a heat welded seam 480. The sleeve tapers from the diameter of the cylinderical section 460 to a diameter of the incoming pipe on the other end. A standard hose clamp 466 attaches the end of sleeve 464 to the unthreaded end 460*b* of cylinder 460, in a conventional manner.

FIG. 29 illustrates a method of installing the overliner membrane, somewhat exaggerating a few of the problems which have been encountered. First the pit 434 was dug and then enough ballast was installed at 478 to insure that the tank 432 would be stable and fully supported. When the ballast reaches some desirable level above the top of the tank, the overliner membrane 418 was laid out over the ballast.

Then, more ballast is added on each side of the membrane as its sides raise to form the basin. As shown in FIG. 29, it is assumed that the ballast inside the membrane, at 480, was spread before there was enough ballast outside the membrane to hold it in place. Therefore the membrane bulged out to the left. Then, to bring the raising membrane wall back into position, more ballast was dumped at 482 and the membrane bulged out to the right before the inside of raising membrane wall was fully supported on the inside. Thus, the membrane first spread outwardly at 480 and then inwardly at 482. The resulting stresses could tear the membrane. Also, pockets could form in the side wall to collect fluid which could not be pumped out of the membrane basin. At 484, the raising vertical wall of the membrane was being shored in a proper manner, but then it is assumed that an avalanche of the ballast buried the edge 485 of the membrane 418. This burial will require a removal of the ballast, and perhaps damage the membrane, in the process.

FIG. 29 has been drawn to exemplify a only few of the problems which may occur in a conventional installation. Of course, no cave in or distortion of the membrane can be predicted because if it could be predect, it could also be prevented. Still, the problems do occur with great frequency. Thus, it is apparent that even a skilled and careful worker can experience problems of these or similar types.

According to the invention, a frame 482 (FIGS. 27, 30, and 31) is constructed in the area of the ballast which is to receive and support the overliner membrane 418. A particularly low cost and satisfactory way of constructing the frame is to make it from water pipe because all of the conventional fittings may be used. These fittings include (FIG. 27) flanges 484, angles 486, and tees 488. Of course, many other fittings may be used to build any of many differently shaped fences, which could fit into almost any installation.

Then, the edges of the overliner membrane 418 are hooked onto each of the pipes (as at 490) at intervals along the length of the pipe. Thus, the membrane is fully supported by the ballast under it. Its edges are supported in an elevated position by the frame 482.

At the time when the frame is installed (FIG. 30), it is resting directly on the ballast 492 covering the top of the tank 432. The frame will be abandoned at this site when the installation is completed. As shown in FIG. 31, the ballast 494 is poured into the basin formed by membrane 418 suspended inside the frame 482. At the same time, ballast is also poured outside the membrane, at 496, 498. As the pile of ballast increases both sides of the membrane are fully supported. However, unlike the prior art situation, the edges of membrane 418 are restrained by frame 482 so that they can not be dislodged by the kind of imbalance of ballast that is seen in FIG. 29.

Another advantage of the orderly installation that is shown in FIG. 31 is that the ballast may be more carefully graded so that liquid collecting in the bottom of the basin formed by the membrane drains properly so that it may be pumped away. Also, the better controlled vertical hang of the side walls tends to resist the kinds of dislocations that are illustrated in FIG. 29 and the like.

Those who are skilled in the art will readily perceive how to modify the invention. Therefore, the appended claims are to be construed to cover all equivalent structures which fall within the true scope and spirit of the invention.

The invention claimed is:

1. A secondary containment for a fuel delivery system, comprising means for bulk storing fuel, dispensing means in at least one area which is remote from said bulk storing means for delivering said fuel, a system of conduits for delivering fuel from said bulk storing means to said dispensing means, secondary containment means underlying said system of conduits and continuously communicating throughout said conduit delivery system where fuel might spill or leak for containing said spilled or leaked fuel, and means for draining said secondary containment means to a collecting point so that said contained fuel accumulates in at least one area of said containment means from which said contained fuel may be removed.

2. The system of claim 1 wherein said bulk storing means comprises an underground fuel tank, said underlying means comprises a membrane passing under said tank and rising around the perimeter thereof to form a collection basin beneath said tank.

3. The system of claim 1 wherein said bulk storing means comprises a tank having a fill port and double walls, whereby an outer of said double walls collects and contains any fuel leaking through an inner of said double walls, said underlying means comprises a membrane passing over said double walled tank in the area of and surrounding said fill port, and a rigid frame for holding the perimeter of said membrane in a raised position to form a collection basin.

4. The system of either claim 2 or claim 3 wherein said underlying membrane passes under both said dispensing means and said conduits and couples into said basin, said membrane being graded to drain into said basin in order to collect fluids from all of said areas where fuel may spill or leak.

5. The system of claim 4 wherein said membrane passes under and completely wraps around said conduits, said wrapped membrane being sealed to itself, thereby forming an unbroken sleeve completely surrounding said conduits.

6. The system of claim 5 wherein said fuel delivery system is a gasoline filling station and said dispensing means include at least one filling station pump.

7. The system of claim 6 wherein said contained fuel removal area is a pump formed in said collection basin.

8. A process for providing environmental protection for a fuel delivery system, said process comprising the steps of:

(a) forming a fuel delivery area comprising a pit with at least one trench extending from said pit to an area which is remote from said pit;

(b) lining said pit, trench, and remote area with a continuously unbroken membrane for collecting fluids which might spill or leak in said pit, trench and remote area, said membrane being graded to drain said collected fluids into a removal area, (c) locating a fuel tank, delivery conduits, and at least one fuel pump over said membrane whereby said membrane collects any fuel spilled or leaked by said tank, conduits, and pump, and (d) back filling said pit, trench and remote area with ballast whereby said ballast provides a substantially smooth exposed surface covering the fuel delivery area lined by said membrane, said exposed surface of ballast being substantially the same as the level of the earth throughout said fuel delivery area.

9. The process of claim 8 wherein the perimeter of said membrane is raised to form a substantially continuous basin throughout said pit, trench and remote area, the raised perimeter being supported in a raised position by said ballast, and at least part of said perimeter of said membrane being anchored independently of said ballast.

10. The process of claim 9 wherein said membrane encircles said conduits and is sealed upon itself to form a fluid containing sleeve completely surrounding said conduits.

11. The process of claim 10 wherein said fuel tank is a single wall tank located over said membrane.

12. The process of claim 10 wherein said fuel tank is a double walled tank located under said membrane.

13. The process of claim 12 wherein said membrane is mounted on and attached to a frame for forming said membrane into a basin, said membrane and frame being buried with said membrane in said ballast.

* * * * *